United States Patent [19]

Fromm et al.

[11] Patent Number: 4,692,586

[45] Date of Patent: Sep. 8, 1987

[54] PILOT LIGHT ARRANGEMENT FOR STYLING IRON WITH SWIVEL CORD

[75] Inventors: George R. Fromm, Glenview; Philip S. Stefaniak, Hanover Park, both of Ill.

[73] Assignee: Helene Curtis, Inc., Chicago, Ill.

[21] Appl. No.: 871,361

[22] Filed: Jun. 6, 1986

[51] Int. Cl.[4] ..... A45D 1/04

[52] U.S. Cl. ..... 219/225; 219/240; 340/815.31

[58] Field of Search ..... 219/225, 240; 340/815.31, 755; 362/26, 32, 119; 250/227; 132/9, 34 R, 37 R

[56] References Cited

U.S. PATENT DOCUMENTS 4,565,916 1/1986 Tsuji et al. ..... 219/225

4,591,695 5/1986 Inoue ..... 219/225

*Primary Examiner*—Patrick R. Salce

*Assistant Examiner*—Emanuel Todd Voeltz

*Attorney, Agent, or Firm*—Dressler, Goldsmith, Shore, Sutker & Milnamow, Ltd.

[57] ABSTRACT

A pilot light arrangement for a hand-held appliance such as a curling and styling iron is disclosed, wherein the arrangement facilitates convenient visual inspection to see if the appliance is operating. The arrangement includes a pilot light mounted within a housing portion of the appliance, and a fiber optic bundle which extends through a swivel cord mount of the appliance. The fiber optic bundle is positioned in light-transmitting relation with the pilot light, with the end of the fiber optic bundle positioned at the exterior of the appliance being readily visible irrespective of the orientation of the swivel cord mount with respect to the appliance housing.

6 Claims, 2 Drawing Figures

PILOT LIGHT ARRANGEMENT FOR STYLING IRON WITH SWIVEL CORD

TECHNICAL FIELD

The present invention relates generally to hand-held electrical appliances, and more particularly to a pilot light arrangement, including a fiber optic bundle, particularly suited for use in an appliance such as a hairstyling iron having a swivel cord.

BACKGROUND OF THE INVENTION

Many electrical appliances are provided with a pilot light which operates attendant to supply of electrical power to the appliance. The provision of a pilot light is particularly desirable for some types of hand-held appliances, such as electrically-heated curling and hair styling irons. Since an iron of this type includes a heated barrel portion about which hair is wrapped for styling, the provision of a pilot light for indicating operation of the iron helps a user easily check to see if the iron is heating, and avoid inadvertently touching the heated barrel.

While some previous styling irons have included a pilot light in the handle portion of the iron which is visible through a suitable opening or transparent lens, these previous arrangements are typically configured such that the pilot light is not visible when it is facing away from a user. Thus, if the iron is resting on a table or vanity, it may not be readily apparent to a user that the iron is operating. This can be particularly undesirable for a professional hairstylist, since it detracts from the efficiency with which a styling iron can be used.

Accordingly, it is desirable to provide a pilot light arrangement such as for a hand-held styling iron or other electrical appliance so that a user can readily discern if the iron is operating, thus promoting efficient use and avoiding inadvertent contact with the heated barrel of the iron.

SUMMARY OF THE INVENTION

In accordance with the present invention, a pilot light arrangement is disclosed which is particularly suited for use in a hand-held electrical appliance such as a curling and styling iron which includes a swivel electrical cord. Notably, the arrangement includes a fiber optic bundle positioned in light-transmitting relation with a pilot light disposed within a housing of the appliance. The fiber optic bundle is arranged so that it is visible from the exterior of the appliance, regardless of the orientation of the appliance housing, thus facilitating convenient inspection to see whether the appliance is operating.

While the illustrated embodiment of the present invention is shown as a hand-held curling and styling iron, it will be appreciated that the present invention is readily adaptable for use in other electrical appliances having a suitable housing. In the illustrated embodiment of the invention, the appliance housing comprises the handle portion of the styling iron.

The present construction includes a swivel cord mount rotatably connected to the appliance housing for rotation relative thereto about an axis. The provision of a swivel cord mount is particularly desirable for a styling iron, since it facilitates convenient manipulation of the iron without tangling of its electrical cord.

The present invention further includes a pilot light positioned within the housing of the appliance for indicating supply of electrical power to the appliance. The pilot light may comprise a neon bulb suitably wired to the circuitry of the appliance for operation when the appliance has been switched on.

In order to permit a user to inspect the pilot light, the present construction includes a fiber optic bundle extending through the swivel cord mount, preferably generally along the axis of rotation of the cord mount. The fiber optic bundle has one end portion thereof positioned in operative association with the pilot light disposed within the housing. An opposite end of the fiber optic bundle is positioned at the exterior of the appliance, preferably at the exterior of the swivel cord mount, whereby operation of the pilot light is visible from the exterior of the appliance by light transmission through the fiber optic bundle. By this arrangement, the exterior end of the fiber optic bundle can be readily viewed regardless of the orientation of the appliance housing, thus greatly facilitating convenient inspection of the appliance to see if it is operating.

In the preferred form, the present construction includes first and second, generally tubular conductive members connected to the swivel cord mount for rotation therewith. The conductive members are respectively electrically joined to the leads of the electrical cord positioned within the cord mount, with the conductive members arranged generally concentrically. First and second, wiper-type electrical contacts are provided within the appliance housing for respective electrical contact with the tubular conductive members attendant to rotation of the swivel cord mount relative to the housing. Notably, the first tubular conductive member extends generally along the rotational axis of the swivel cord mount, with the fiber optic bundle extending through the first conductive member.

Other features and advantages of the present invention will become readily apparent from the following detailed description, the accompanying drawings, and the appended claims.

DETAILED DESCRIPTION

Figures 1, 2:
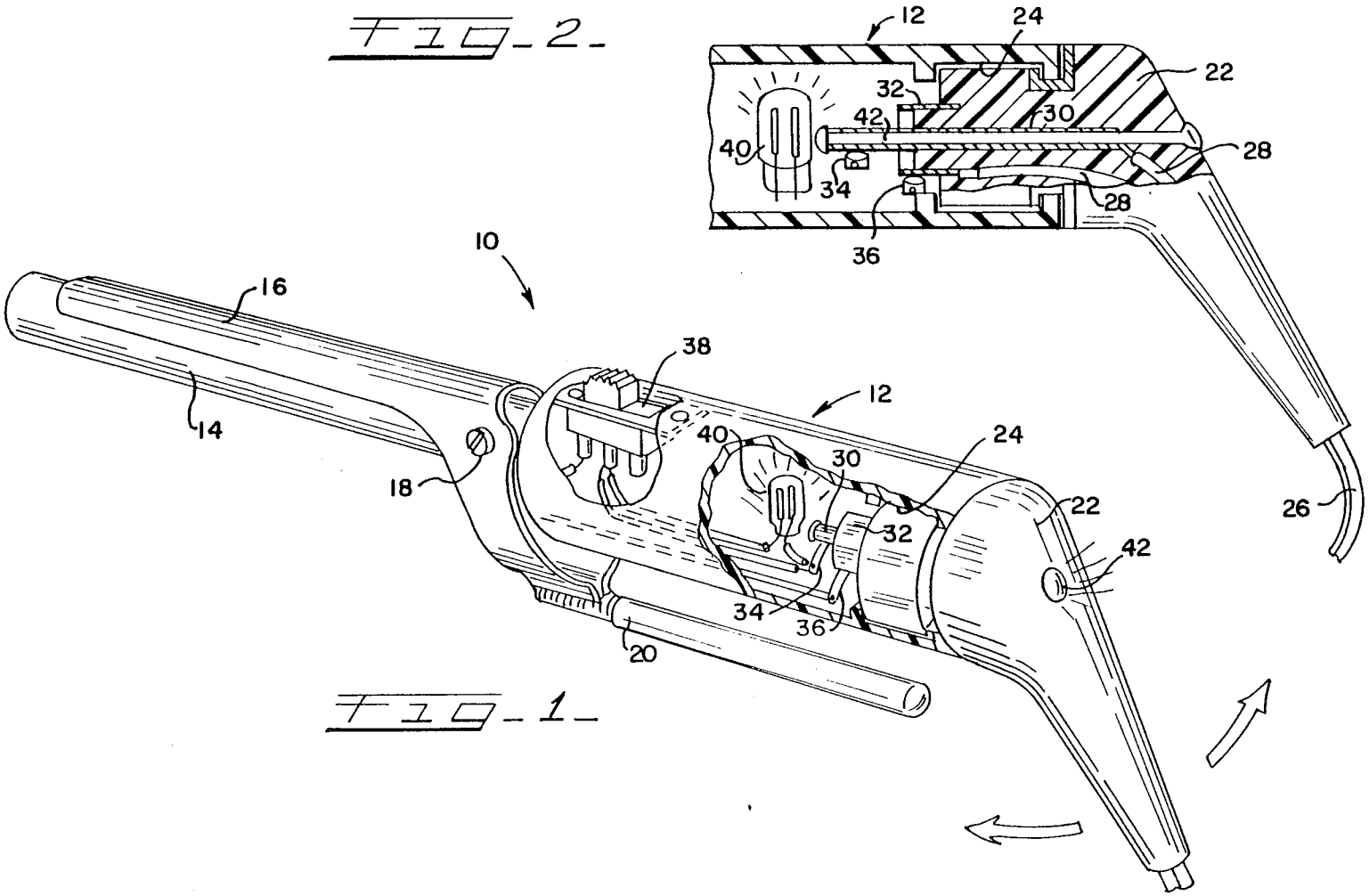
FIG. 1 is a perspective view, partially cut-away, showing a hand-held curling and styling iron having a pilot light arrangement in accordance with the principles of the present invention.
FIG. 2 is a fragmentary, side elevational view in partial cross-section further illustrating the styling iron of FIG. 1 and the pilot light arrangement therefor.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring first to FIG. 1, therein is illustrated an electrical appliance shown as a hand-held curling and styling iron 10. The styling iron 10 includes a housing configured as a handle portion 12 from which extends a heated barrel 14. A clamp 16 is pivotally connected to the barrel at a pivot 18 for movement of the clamp toward and away from heated barrel 14. Hair to be styled may thus be wrapped about the heated barrel, and held in position with the clamp, with a clamp handle 20 facilitating use in this manner.

Since the styling iron 10 is typically rotated about its own longitudinal axis as hair is wound about heated barrel 14, it is desirable to provide an arrangement whereby the electrical cord for the iron can freely swivel, thus avoiding tangling of the cord. To this end, the construction includes a swivel cord mount 22 rotatably connected to the housing 12 such as by disposition within housing cavity 24, whereby the swivel cord mount 22 can rotate relative to the housing about an axis which extends generally coaxially with the housing 12 and the heated barrel 14.

A suitable electrical cord 26 extends into the swivel cord mount 22, with the individual leads 28 of the cord 26 separated from each other within the cord mount. In order to effect an electrical connection between the leads 28 and the circuitry of the styling iron, while still permitting relative rotation of the swivel cord mount, the leads 28 are electrically connected to a pair of first and second electrically conductive members 30 and 32 connected to the swivel cord mount 22. As shown, each of the conductive members 30 and 32 is preferably tubular, with the members arranged concentrically along the rotational axis of swivel cord mount 22.

Conductive members 30 and 32 are electrically joined with the circuitry of the iron by first and second wiper-type electrical contacts 34 and 36 positioned within housing 12 for respective contact with the conductive members. As will be recognized, this arrangement provides the desired electrical connection with the components of the iron, irrespective of the relative rotational position of swivel cord mount 22.

Suitable wiring from electrical contacts 34 and 36 is provided which electrically joins the contacts with an on-off switch 38, and with the electrical heating element (not shown) of the iron. In accordance with the present invention, a pilot light 40 is provided within housing 12, and is electrically joined to the wiring of the iron so that the pilot light operates when electrical power is being supplied to the heating element of the iron.

In order to facilitate convenient inspection of the pilot light 40 irrespective of the relative disposition of housing 12, the present construction includes a fiber optic bundle 42 extending through swivel cord mount 22. The fiber optic bundle is preferably positioned to extend generally along the rotational axis of the swivel cord mount 22, thus maintaining the desired orientation of the fiber optic bundle relative to pilot light 40.

To this end, the fiber optic bundle 42 is positioned to extend through first conductive member 30. Thus, the fiber optic bundle is arranged such that one end of the bundle is positioned in operative association with the pilot light 40, with the opposite end of the bundle positioned at the exterior of swivel cord mount 22 so that the pilot light is visible by light transmission through the fiber optic bundle. In the preferred embodiment, a plastic fiber optic bundle is employed, with suitable integral lenses heat-formed at opposite ends of the bundle to facilitate viewing, as well as for holding the fibers of the bundle in place.

From the foregoing, it will be observed that numerous modifications and variations can be effected without departing from the true spirit and scope of the novel concept of the present invention. It will be understood that no limitation with respect to the specific embodiments illustrated herein is intended or should be inferred. The disclosure is intended to cover by the appended claims all such modifications as fall within the scope of the claims.

What is claimed is:

1. A pilot light arrangement for an electrical appliance having a housing, comprising:

a swivel cord mount rotatably connected to said appliance housing for rotation relative thereto about an axis;

a pilot light positioned within said housing for indicating supply of electrical power to said appliance; and fiber optic means extending through said swivel cord mount, said fiber optic means having one end positioned in operative association with said pilot light, and an opposite end positioned at the exterior of said appliance whereby operation of said pilot light is visible from the exterior of said appliance by light transmission through said fiber optic means.

2. A pilot light arrangement in accordance with claim 1, wherein said electrical appliance comprises a hand-held hair curling and styling iron, said housing comprising a handle portion of said styling iron.

3. A pilot light arrangement in accordance with claim 1, wherein said fiber optic means extends generally along said axis of rotation of said swivel cord mount.

4. A pilot light arrangement in accordance with claim 1, including first and second electrically conductive members connected to said swivel cord mount for rotation therewith, and first and second electrical contacts mounted within said housing for respective electrical contact with said first and second conductive members, said fiber optic means extending within said first conductive member.

5. A pilot light arrangement for a hand-holdable electrical appliance having a housing, comprising:

a swivel cord mount rotatably connected to said housing for rotation relative thereto about an axis;

a pilot light positioned within said housing for indicating supply of electrical power to said appliance;

first and second generally tubular, concentrically arranged electrically conductive members, said first and second conductive members being connected to said swivel cord mount for rotation therewith, with the axes of said conductive members arranged generally coaxially with said axis of rotation of said swivel cord mount, said first conductive member extending through said second conductive member;

first and second electrical contacts mounted within housing for respective electrical contact with said first and second conductive members; and fiber optic means extending through said first conductive member in said swivel cord mount generally along said axis of rotation of said swivel cord mount, said fiber optic means having one end positioned in operative association with said pilot light, and an opposite end positioned at the exterior of said swivel cord mount, whereby operation of said pilot light is visible from the exterior of said appliance by light transmission through said fiber optic means;

6. A pilot light arrangement in accordance with claim 5, wherein said hand-held appliance comprises a hair curling and styling iron.

* * * * *